US009279251B2

(12) United States Patent
Bergman

(10) Patent No.: US 9,279,251 B2
(45) Date of Patent: Mar. 8, 2016

(54) MOUNTING HARDWARE AND MOUNTING SYSTEM FOR VERTICAL PANELS

(71) Applicant: AWI LICENSING COMPANY, Wilmington, DE (US)

(72) Inventor: Todd M. Bergman, Lititz, PA (US)

(73) Assignee: AWI Licensing Company, Wilmington, DE (US)

( * ) Notice: Subject to any disclaimer, the term of this patent is extended or adjusted under 35 U.S.C. 154(b) by 60 days.

(21) Appl. No.: 14/204,299

(22) Filed: Mar. 11, 2014

(65) Prior Publication Data

US 2014/0190109 A1 Jul. 10, 2014

Related U.S. Application Data

(63) Continuation of application No. 13/474,077, filed on May 17, 2012, now Pat. No. 8,695,296.

(60) Provisional application No. 61/486,991, filed on May 17, 2011.

(51) Int. Cl.

| | |
|---|---|
| ***E04B 9/00*** | (2006.01) |
| ***E04B 9/22*** | (2006.01) |
| ***E04B 9/24*** | (2006.01) |
| ***E04B 9/20*** | (2006.01) |
| ***E04B 9/36*** | (2006.01) |
| ***E04B 1/41*** | (2006.01) |

(52) U.S. Cl.
CPC . *E04B 9/205* (2013.01); *E04B 1/40* (2013.01); *E04B 9/008* (2013.01); *E04B 9/225* (2013.01); *E04B 9/24* (2013.01); *E04B 9/366* (2013.01)

(58) Field of Classification Search
CPC ..... E04B 9/006; E04B 9/008; E04B 9/22; E04B 9/18; E04B 9/225; E04B 9/24; E04B 9/36
See application file for complete search history.

(56) References Cited

U.S. PATENT DOCUMENTS

| | | | | |
|---|---|---|---|---|
| 2,386,887 A | | 10/1945 | Eckel | |
| 2,499,278 A | * | 2/1950 | Olsen | E04B 9/16 248/340 |
| 3,561,717 A | * | 2/1971 | Frederick | B65G 17/20 118/500 |
| 3,567,169 A | | 3/1971 | Frederick et al. | |
| 3,612,461 A | * | 10/1971 | Brown | E04B 9/18 248/317 |
| 3,986,314 A | | 10/1976 | Moeller | |
| 4,031,664 A | * | 6/1977 | Wendt | E04B 1/6116 248/300 |

(Continued)

FOREIGN PATENT DOCUMENTS

| | | | | |
|---|---|---|---|---|
| CA | 2321341 A1 | * | 3/2002 | E04B 9/006 |
| EP | 0197594 A2 | | 10/1986 | |

(Continued)

OTHER PUBLICATIONS

International Search Report dated Aug. 23, 2012, for PCT/US2012/38339, Filed May 17, 2012. WO.

*Primary Examiner* — Ryan Kwiecinski
(74) *Attorney, Agent, or Firm* — Craig M. Sterner

(57) ABSTRACT

A mounting clip and a system for mounting a vertical panel from a support member suspended from a ceiling. The mounting clip has a panel mounting section, a support member receiving portion, and a movable mounting section. The support member receiving portion extends from the panel mounting section. The movable mounting section can be rotated relative to the support member receiving portion to secure the mounting clip to the support member.

16 Claims, 10 Drawing Sheets

(56) References Cited

U.S. PATENT DOCUMENTS 4,073,108 A * 2/1978 Williams ..... E04B 9/008 52/238.1
4,227,355 A * 10/1980 Wendt ..... E04B 1/86 160/196.1
4,703,598 A 11/1987 Wilson et al.
4,709,888 A 12/1987 Cubit et al.
4,723,749 A 2/1988 Carraro et al.
4,726,165 A * 2/1988 Brinsa ..... E04B 9/16 52/506.06
4,827,687 A 5/1989 Frawley
5,228,263 A * 7/1993 Vaughn ..... E04B 9/008 52/238.1
5,335,890 A * 8/1994 Pryor ..... A47H 1/04 16/94 D
5,468,035 A 11/1995 Fountain
5,480,116 A * 1/1996 Callas ..... G09F 7/08 248/228.4
5,623,130 A 4/1997 Noxon
5,653,412 A * 8/1997 Martorano ..... F21V 21/025 248/222.11
6,260,810 B1 * 7/2001 Choi ..... F16L 3/24 248/317
6,637,710 B2 10/2003 Yaphe et al.
D513,171 S * 12/2005 Richardson ..... D25/133
7,478,787 B2 1/2009 Bankston et al.
7,637,065 B2 12/2009 Ahren et al.
8,051,618 B2 11/2011 Ahren et al.
8,057,077 B2 * 11/2011 Gagne ..... F21V 21/02 362/147
2002/0060280 A1 5/2002 Yaphe et al.
2007/0101670 A1 * 5/2007 Ahren ..... E04B 9/28 52/522
2007/0145222 A1 * 6/2007 Rausch ..... F16L 3/02 248/317
2010/0011699 A1 1/2010 Weimer et al.
2011/0011023 A1 * 1/2011 Gulbrandsen ..... E04B 9/065 52/506.07
2011/0232219 A1 * 9/2011 Wilkinson, Jr. ..... G09F 7/18 52/474
2012/0291397 A1 * 11/2012 Bergman ..... E04B 9/366 52/745.21

FOREIGN PATENT DOCUMENTS

JP 06257234 A 9/1994
RU 57774 U1 10/2006
SU 1725740 A3 4/1992

* cited by examiner

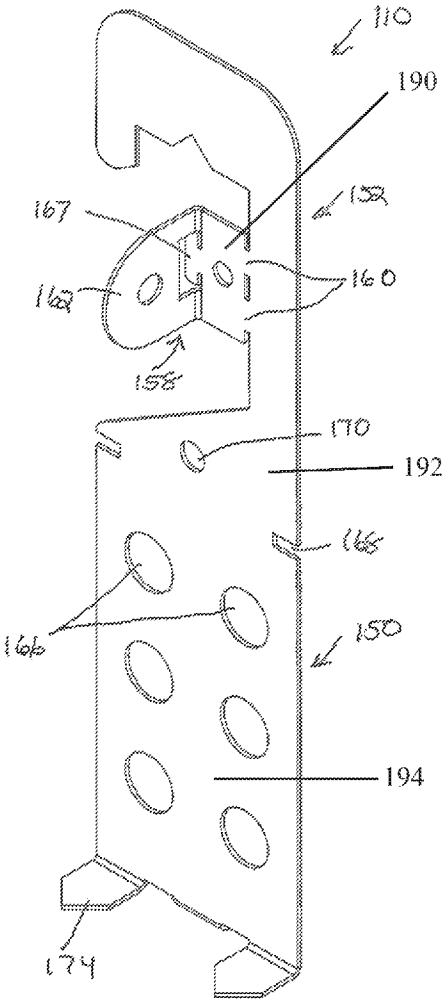
FIG. 13
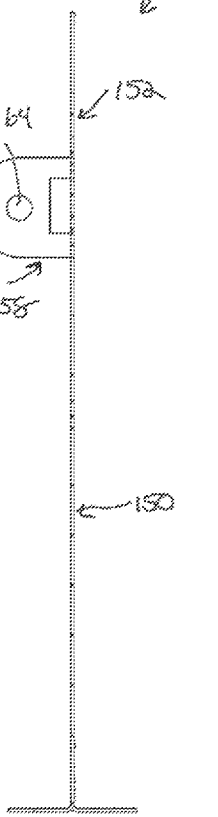
FIG. 15
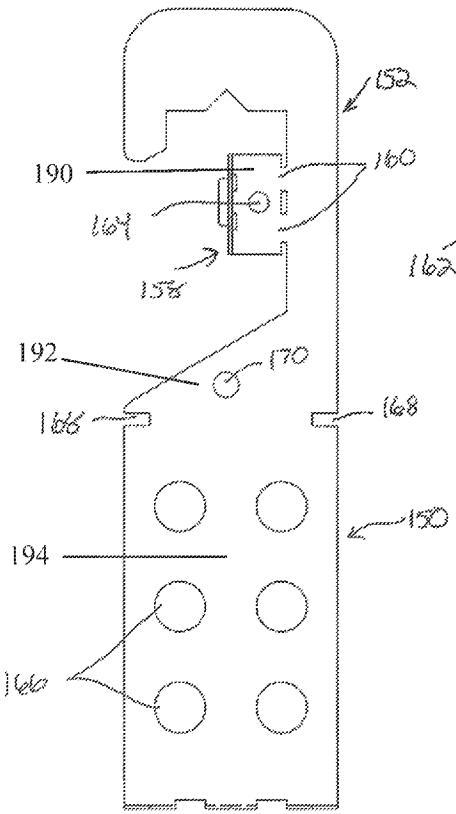
FIG. 14
FIG. 16

110
112
114
116
118
120
122
124
126
128
130
132
134
136
138
140
142
143
144
145
146
148
150
152
154
156
158
160
162
164
166
168
170
172
174
176
178
180
182
184
186
188
190
192
194
196
198
200
202
204
206
208
210
212
214
216
218
220
222
224

MOUNTING HARDWARE AND MOUNTING SYSTEM FOR VERTICAL PANELS

CROSS-REFERENCE TO RELATED APPLICATIONS

The present application is a continuation of U.S. patent application Ser. No. 13/474,077, filed on May 17, 2012, now allowed, which in turn claims the benefit of U.S. Provisional Patent Application Ser. No. 61/486,991, filed on May 17, 2011, the entireties of which are incorporated herein by reference.

FIELD OF THE INVENTION

The present invention is directed to mounting hardware and mounting system for use with vertical panels, and more particularly to mounting hardware for vertically extending acoustical ceiling baffles.

BACKGROUND OF THE INVENTION

In many commercial buildings, it is desirable to alter room acoustics by providing vertically extending ceiling components intended to absorb sound waves to diminish room noise. In addition, vertically extending panels may be used to aesthetically separate areas of a large space with overhead panels or decorative valances projecting downward from a ceiling. These overhead panels are also referred to as soffits, valances, and bulkheads in different settings. Additionally, overhead panels may be connected to a ceiling to provide a vertical mounting surface for advertising information, menu information, or other displays in various retail establishments.

Generally, vertically extending panels are mounted using wires which are directly mounted to the ceiling. However, as the panels are mounted with wires or the like, the repair and replacement of the panels is made difficult, as there is no easy method of removing the panels from the wires. In addition, as the panels are mounted directly to the ceiling, in order to move or rearrange the panels requires that the wires be removed from the ceiling and reaffixed to the ceiling in a different location. This is both time consuming and costly. In addition, depending on the duct work, lighting, etc. found in the ceiling, the mounting of the panels in the proper position may be difficult to accomplish.

It would, therefore, be beneficial to provide mounting hardware and a mounting system which allowed to the vertical panels to be easily removed and replaced, thereby allowing the repair or replacement of damaged panels. It would also be beneficial to provide mounting hardware and a mounting system which allows for the repositioning of the panels as needed.

SUMMARY OF THE INVENTION

One embodiment of the invention is directed to a mounting hardware for mounting a vertical panel from a support member suspended from a ceiling. The mounting hardware has a panel mounting section, a support member receiving portion, and a movable mounting section. The support member receiving portion extends from the panel mounting section. The movable mounting section can be rotate relative to the support member receiving portion to secure the mounting hardware to the support member.

One embodiment of the invention is directed to a mounting system for mounting at least one vertical panel to a ceiling. The mounting system has a support member suspended from the ceiling and mounting hardware for mounting the at least one vertical panel to the support member. The mounting hardware has a panel mounting section, a support member receiving portion, and a movable mounting section. The support member receiving portion extends from the panel mounting section. The movable mounting section can be rotate relative to the support member receiving portion to secure the mounting hardware to the support member.

One embodiment of the invention is directed to a method of mounting a vertical panel to a ceiling. The method comprising: positioning a support member receiving portion of a mounting hardware on a support member which is extended from the ceiling; rotating a movable mounting section relative to the support member receiving portion to secure the mounting hardware to the support member; and securing a the vertical panel to a panel mounting section of the mounting hardware.

In one aspect, the invention can be a system for mounting a vertical panel from a ceiling, the system comprising: a support member suspended from the ceiling; a mounting clip for mounting the vertical panel to the support member, the mounting clip comprising: a horizontal plate having a top surface, a bottom surface, a first end, and a second end opposite the first end; a movable mounting section rotatably coupled to the second end of the horizontal plate so as to be rotatable about a first rotational axis, the movable mounting section comprising a horizontal portion and a mounting flange extending downwardly from the horizontal portion; and wherein the movable mounting section is rotatable between: (1) a first position in which a top surface of the horizontal portion of the movable mounting section is in plane with the top surface of the horizontal plate; and (2) a second position in which the top surface of the horizontal portion of the movable mounting section is adjacent to the top surface of the horizontal plate so that a first slot is formed between the top surface of the horizontal portion of the movable mounting section and the top surface of the horizontal plate.

In another aspect, the invention can be a system for mounting a vertical panel from a ceiling, the system comprising: a support member suspended from the ceiling; a mounting clip for mounting the vertical panel to the support member, the mounting clip comprising: a horizontal plate having a top surface, a bottom surface, a plate axis extending between a first end and a second end, and a first edge and a second edge extending between the first and second ends; a movable mounting section rotatably coupled to the second end of the horizontal plate so as to be rotatable about a first rotational axis, the first rotational axis being substantially parallel to the plate axis; a first vertical sidewall extending downwardly from and rotatably coupled to the first edge of the horizontal plate so as to be rotatable about a second rotational axis, the second rotational axis being substantially transverse to the plate axis; and a second vertical sidewall extending downwardly from and rotatably coupled to the second edge of the horizontal plate so as to be rotatable about a third rotational axis, the third rotational axis being substantially transverse to the plate axis.

In a further aspect, the invention can be a mounting clip for mounting a vertical panel to a support member, the mounting clip comprising: a horizontal plate having a plate axis extending between a first end of the horizontal plate and a second end of the horizontal plate; a movable mounting section rotatably coupled to the second end of the horizontal plate so as to be rotatable about a first rotational axis between: (1) a first position in which no portion of the movable mounting section overlaps the horizontal plate; and (2) a second position in which the movable mounting section at least partially overlaps the horizontal plate; a first vertical sidewall rotatably coupled to the horizontal plate so as to be rotatable about a second rotational axis; a second vertical sidewall rotatable coupled to the horizontal plate so as to be rotatable about a third rotational axis; and wherein the first rotational axis is substantially parallel to the plate axis and wherein each of the second and third rotational axes are substantially transverse to each of the plate axis and the first rotational axis.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 12 is a perspective view of a panel positioned proximate to and mounted on two support members.

FIG. 13 is a perspective view of an alternate exemplary mounting hardware according the invention.

FIG. 14 is a side view of the exemplary mounting hardware shown in FIG. 13.

FIG. 15 is an end view of the exemplary mounting hardware shown in FIG. 13.

FIG. 16 is a bottom view of the exemplary mounting hardware shown in FIG. 13.

DETAILED DESCRIPTION OF THE INVENTION

Figure 1:
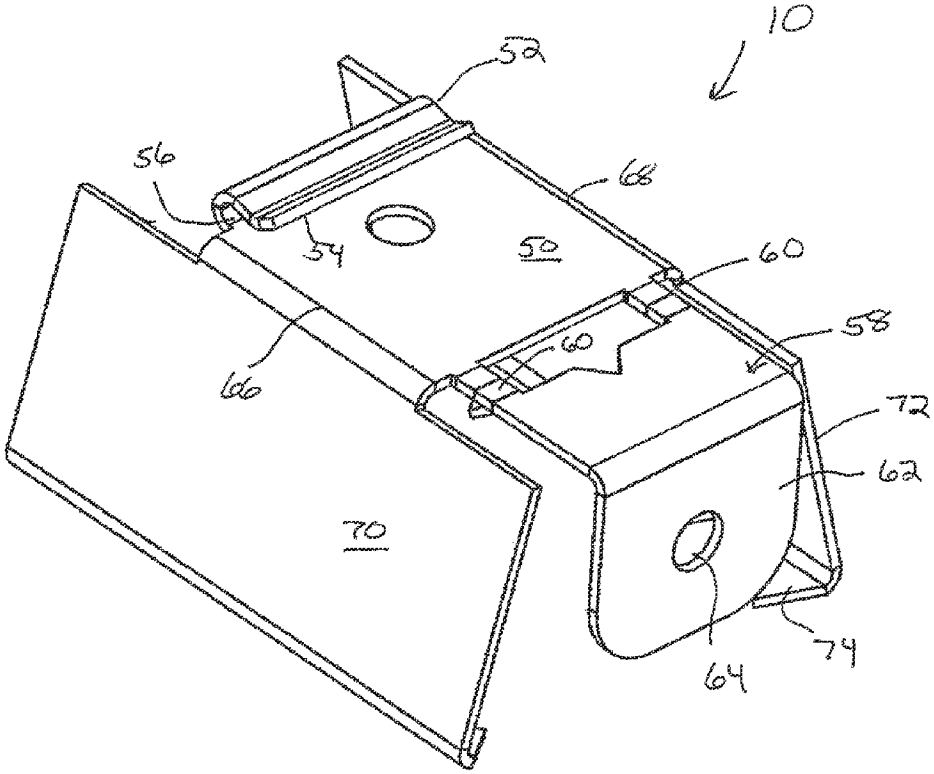
FIG. 1 is a perspective view of an exemplary mounting hardware according the invention.
Figure 2:
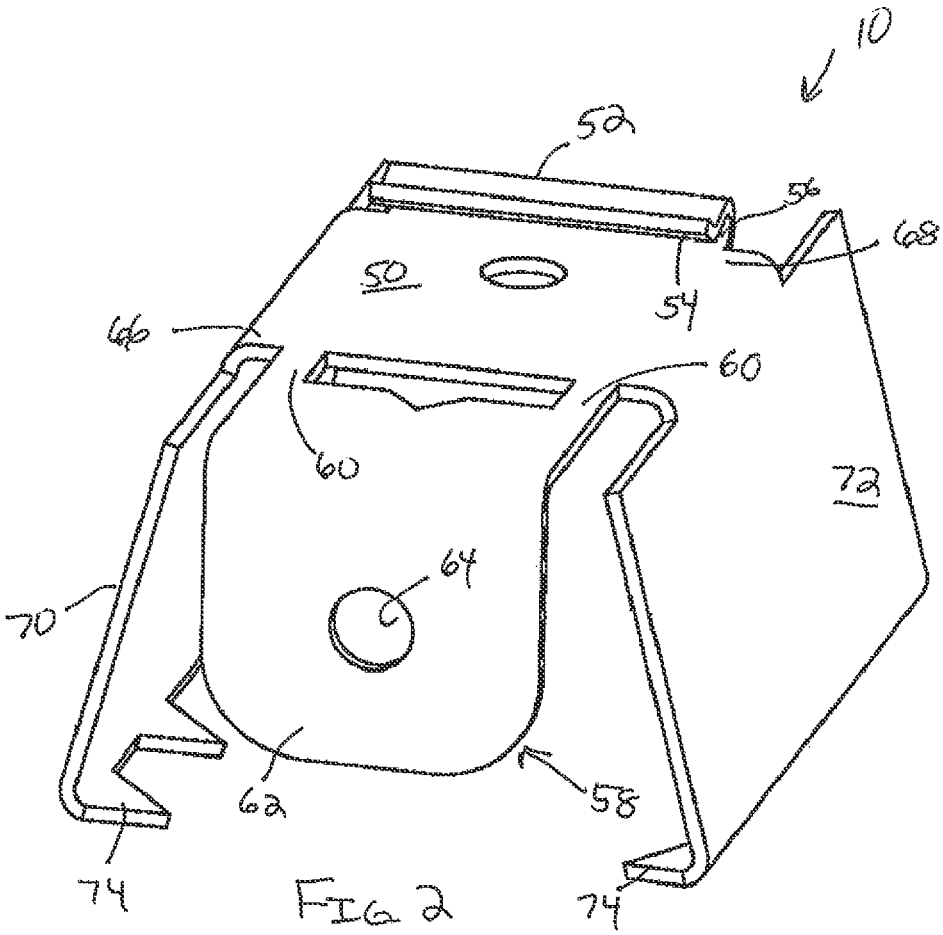
FIG. 2 is an alternate perspective view of the exemplary mounting hardware shown in FIG. 1.
Figure 3:
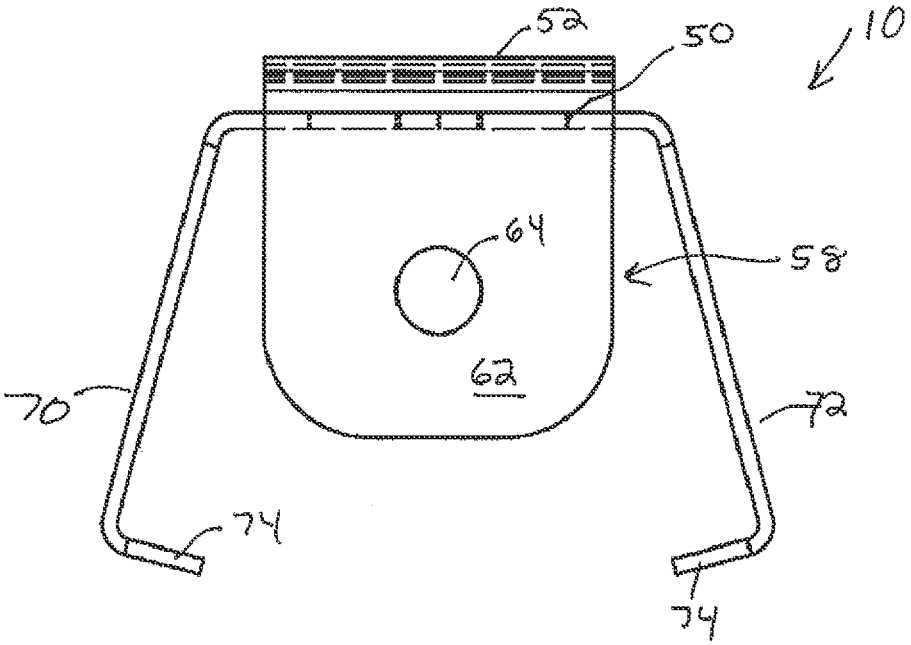
FIG. 3 is an end view of the exemplary mounting hardware shown in FIG. 1.
Figure 5:
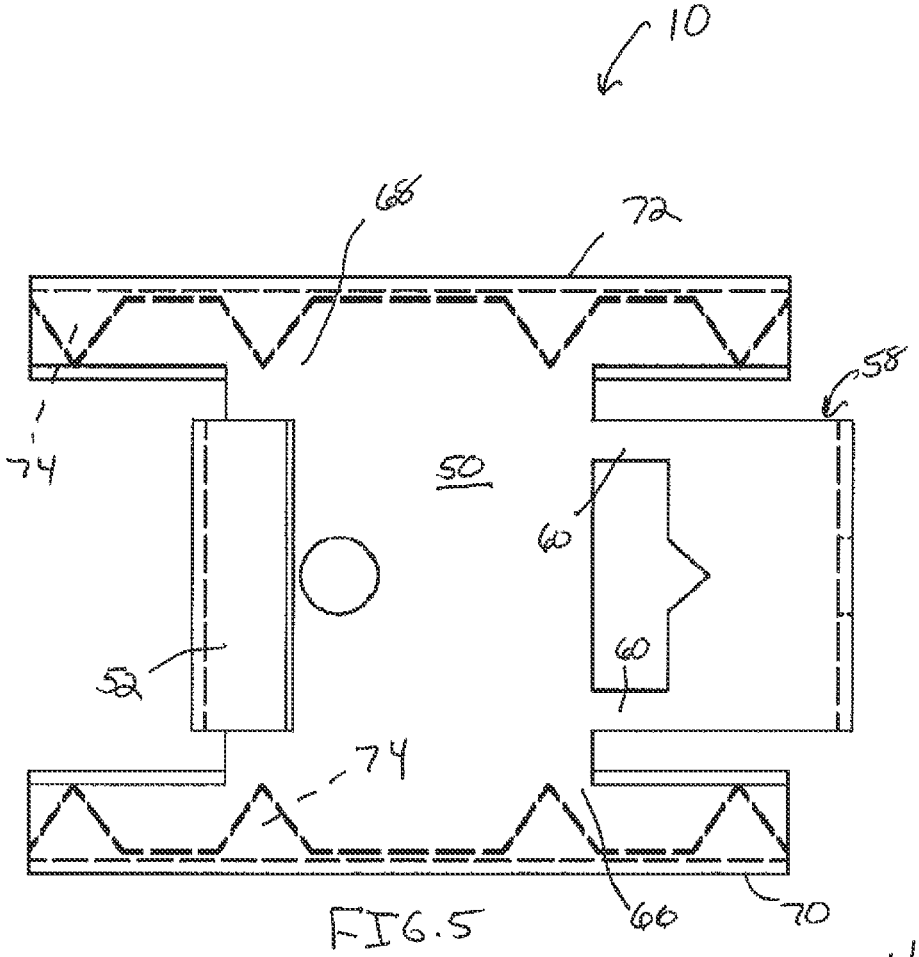
FIG. 5 is a top view of the exemplary mounting hardware shown in FIG. 1, with the teeth shown in phantom.
Figure 4:
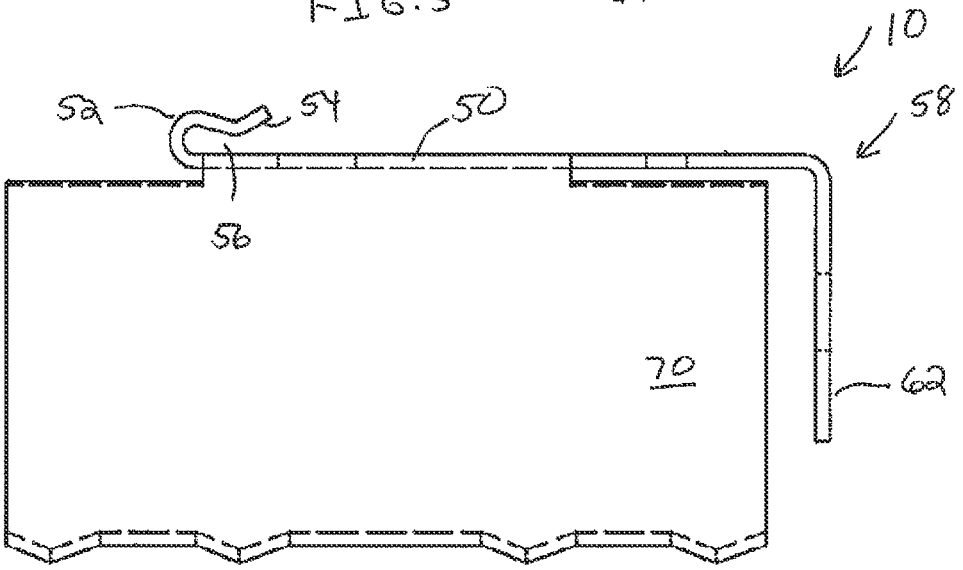
FIG. 4 is a side view of the exemplary mounting hardware shown in FIG. 1.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "vertical", "horizontal", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "upper" elements or features would then be oriented "lower" than the other elements or features. Thus, the exemplary term "upper" can encompass both an orientation of upper and lower. The device may be otherwise oriented (rotated 90 degrees or at other orientations) and the spatially relative descriptors used herein interpreted accordingly.

FIGS. 1 through 7 illustrate an exemplary embodiment of mounting hardware 10 and a mounting system 12 for mounting a vertical panel 14 to a structural support member 16 which is mounted to a ceiling or the like. The panels may be used for different purposes, including, but not limited to improving the acoustics of the space, aesthetically separating areas of a large space, or providing a vertical mounting surface for advertising information, menu information, or other displays in various retail establishments.

Figure 6:
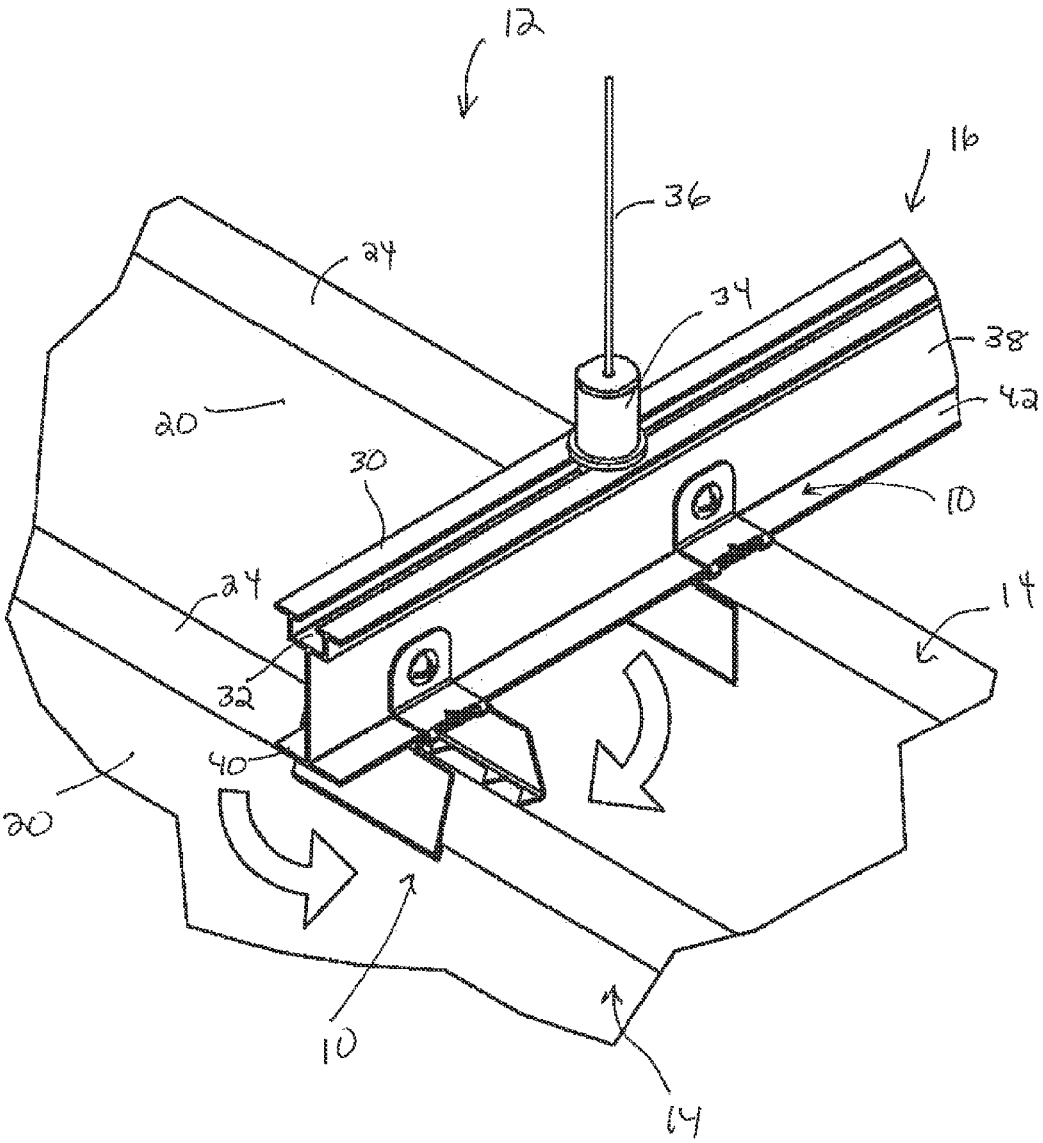
FIG. 6 is a perspective view of two panels positioned proximate a support member, with one of the mounting hardware shown in an open position and the other mounting hardware shown in a closed position.
Figure 7:
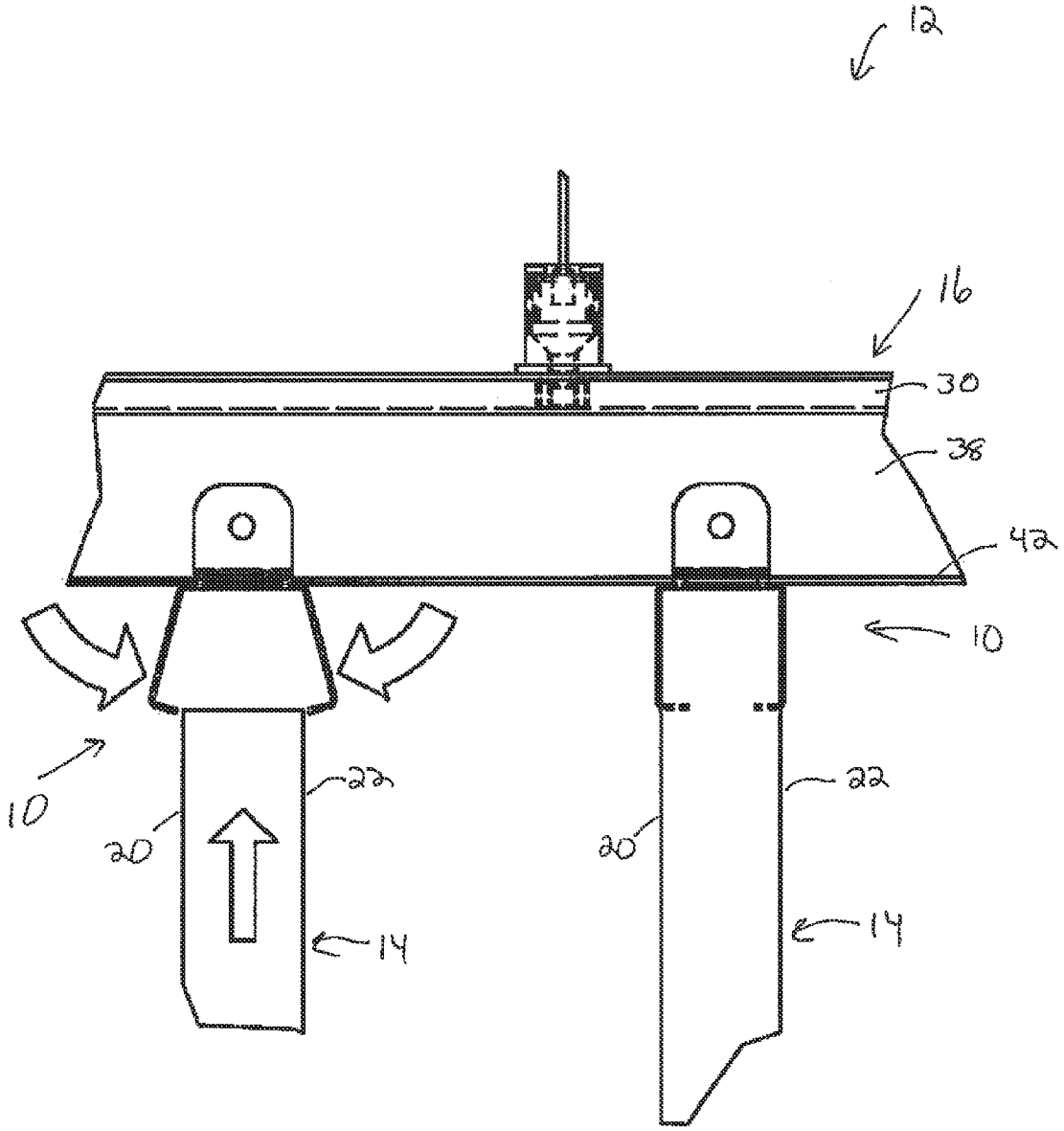
FIG. 7 is an end view of the two panels, support member and mounting hardware shown in FIG. 6.

In accordance with one exemplary embodiment of the invention, the mounting system 12 provides a platform for mounting at least one overhead, vertical panel 14 that is supported on the support member 16, as will be discussed in further detail below. The overhead panel 14 drops down in a generally vertical orientation from the plane of the ceiling and can be combined with additional panels 14 or used individually. FIGS. 6 and 7 illustrate a perspective view of the overhead mounting system 12 in accordance with one exemplary embodiment. The mounting system 12 includes one or more support members 16, the mounting hardware 10, and one or more panels 14.

The panels 14 are any known panels which perform the desired function. As is best shown in FIGS. 6, 7 and 12, in general, the panels are made from lightweight material having a first surface 20 and an oppositely facing second surface 22. A mounting surface or edge 24 extends between the first surface 20 and the second surface 22. In the exemplary embodiment shown, the panels 14 are rectangular, however, the panel can take any suitable shape, length, or width. While other embodiments may be used, in one example the panel 14 contains a cellular core having first and second side walls that are covered by a veneer or laminated outer skin. The veneer or outer skin may be any color according to the aesthetic desired. The cellular core may be made of a foam material, such as, but not limited to polystyrene that allows the vertical panel to be lightweight, for example, around 1-2 pounds per linear foot of elongate length. The outer skin may be formed of a suitable lightweight material, such as, but not limited to, material having the acoustic properties required, high impact polystyrene or expanded PVC. The type of material will depend upon the application for which the panel is to be used.

As is best shown in FIGS. 6, 7 and 12, in the exemplary embodiment shown, the support members 16 have a modified I-shaped cross-section, which is most clearly shown in FIG. 6. The support member 16 has a top mounting section 30 having a slot 32 for receiving an end 34 of a mounting wire 36 which is mounted to the ceiling or the like. However, other configurations of the top mounting section 30 and other methods of mounting the support member 16 to the ceiling can be used without departing from the scope of the invention. A vertical flange 38 extends between the mounting section 30 and horizontal cross members or flanges 40, 42. As shown in the alternate embodiment of FIG. 12, locating slots 43 may also be provided periodically along the vertical flange 38.

According to the exemplary embodiment, the mounting hardware or mounting clip 10 includes an upper generally horizontal plate 50 with a support member receiving portion or flange receiving portion or hook arm 52 which extends from one end thereof. The hook arm 52 has a lead-in surface 54 and a slot 56. Extending from the other end of the horizontal plate 50 is a movable mounting section 58. The movable mounting section 58 has connection legs 60 which extend between the plate section 50 and the mounting section 58, the legs 60 being configured to allow the mounting section 58 to rotate about the plate section 50. Specifically, the mounting section 58 is rotatable about a first rotational axis B-B. The mounting section 58 has a mounting flange 62 with a screw receiving opening 64 which extends therethrough. As shown in the alternate exemplary embodiment of FIG. 8 through 12, a locating tab 67 may also be provided on the mounting section 58.

Figure 8:
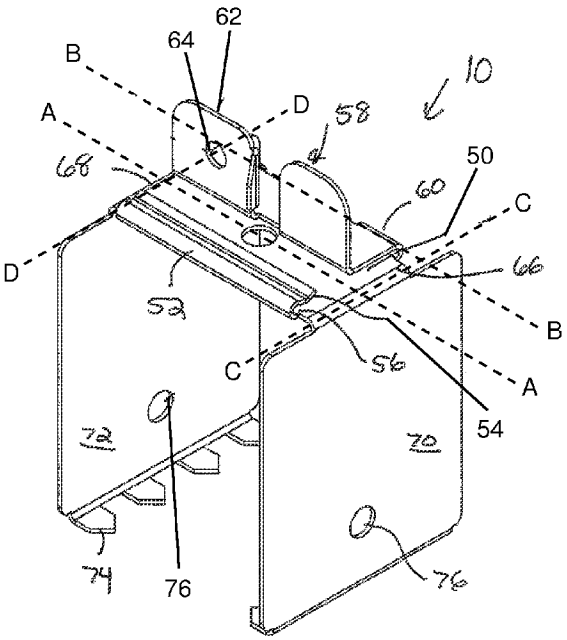
FIG. 8 is a perspective view of an alternate exemplary mounting hardware according the invention.
Figure 10:
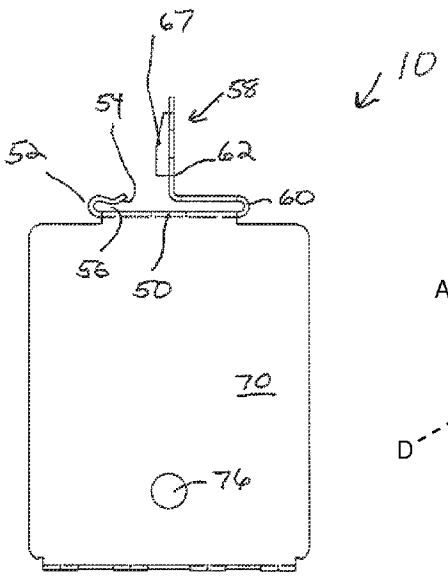
FIG. 10 is a side view of the exemplary mounting hardware shown in FIG. 8.
Figure 9:
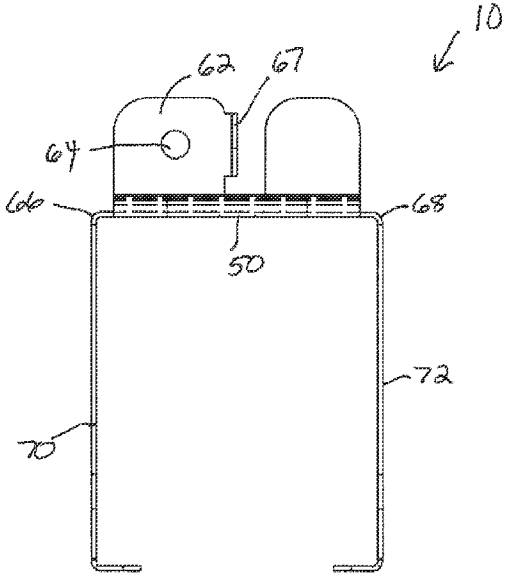
FIG. 9 is an end view of the exemplary mounting hardware shown in FIG. 8.
Figure 11:
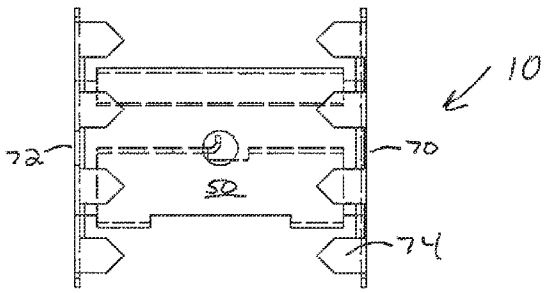
FIG. 11 is a bottom view of the exemplary mounting hardware shown in FIG. 8.

The plate section 50 has a first edge 66 and an oppositely facing second edge 68. A plate axis A-A extends between the first edge 66 and the second edge 68, as illustrated in FIG. 8. The first rotational axis B-B about which the mounting section 58 rotates is substantially parallel to the plate axis A-A (FIG. 8). A first vertical sidewall section 70 extends downwardly from the plate section 50 at the first edge 66. A second vertical sidewall section 72 extends downwardly from the plate section 50 at the second edge 68. The first and second vertical sidewall sections 70, 72 extend from the plate section 50 such that the first and second vertical sidewall sections 70, 72 are allowed to rotate or pivot about the plate section 50 allowing the first and second vertical sidewall sections 70, 72 to be moved between an open and a closed position. More specifically, the first vertical sidewall section 70 is rotatable about a second rotational axis C-C and the second vertical sidewall section 72 is rotatable about a third rotational axis D-D. The second rotational axis C-C and the third rotational axis D-D are substantially traverse to the plate axis A-A (FIG. 8). The plate section 50 and the first and second vertical sidewall sections 70, 72 form a panel mounting section. The first and second vertical sidewall sections 70, 72 include a plurality of teeth 74, which, in the exemplary embodiment shown, are also formed along the length of the sidewall sections 70, 72 proximate the edge of the first and second vertical sidewall sections 70, 72 which are furthest from the plate section 50. The teeth 74 are substantially in alignment on both the first and second vertical sidewall sections 70, 72 so that the teeth 74 are in general vertical alignment with each other in elevation when the first and second vertical sidewall sections 70, 72 are moved to the closed position, as will be more fully described. However, other configurations of the teeth 74 are possible without departing from the scope of the invention.

An optional opening 76 may be provided in the first and second vertical sidewall sections 70, 72. This opening is shown in the embodiment illustrated in FIGS. 8 through 12, however, the opening may be provided in other embodiments, including, but not limited to the embodiment shown in FIGS. 1 through 7. The openings 76 permit mounting hardware 78, such as, but not limited to, a nut and bolt, to extend through the openings.

Referring to FIGS. 6, 7 and 12, the mounting hardware or mounting clips 10 cooperate with the support members 16 to mount the panels 14 to the support members 16 and indirectly to the ceiling. The hook arm 52 of each respective mounting clip 10 is configured to wrap around a respective flange 40, 42 of the support member 16. The respective flange 40, 42 is guided into the slot 56 by lead-in surface 54. Once the respective flange 40, 42 is positioned in the slot 56, the movable mounting section 58 is rotated or pivoted about the connection legs 60, thereby allowing the mounting flange 62 to be moved proximate the vertical flange 38. As this occurs, the locating tab 67 may be inserted into a respective locating slot 37 to help properly position the mounting clip 10 relative to the support member 16. With the mounting flange 62 positioned proximate the vertical flange 38, a screw may be inserted into either the screw receiving opening 64 or the screw receiving opening 65, thereby causing the mounting clips 10 to be securely fastened and positioned relative to the support members 16. The cooperation of the hooked arm 52 and the mounting flange 62 prevents the movement of the mounting clip 10 is a direction which is perpendicular to the longitudinal axis of the support member 16. The use of the screw prevents the movement of the mounting clip 10 is a direction which is essentially parallel to the longitudinal axis of the support member 16.

With the mounting clip 10 properly mounted and maintained in position on the support member 16, the panel 14 is moved into engagement with the mounting clip 10. In order to facilitate the movement of the panel 14 into the mounting clip 10, the first and second vertical sidewall sections 70, 72 are spread apart in the open position. In this position, the first and second vertical sidewall sections 70, 72 are spread apart a distance greater than the width of the panel 14, thereby allowing the panel 14 to be inserted until is positioned proximate to or engages the plate section 50.

With the panel 14 properly inserted between the first and second vertical sidewall sections 70, 72, the first and second vertical sidewall sections 70, 72 are rotated inward, toward each other, thereby moving the first and second vertical sidewall sections 70, 72 from the open position to the closed position. As this occurs the teeth 74 engage and pierce the panel 14. As the teeth 74 dig into the panel and are maintained in this position when the first and second vertical sidewall sections 70, 72 are in the closed position, the panel is maintained in position relative to the mounting clips 10 and the support member 16. The configuration of the first and second vertical sidewall sections 70, 72 allows the first and second vertical sidewall sections 70, 72 to be rotate using a hand tool such as a pliers or the like. This allows the first and second vertical sidewall sections 70, 72 to exhibit a sufficient force on the panel 14 when the first and second vertical sidewall sections 70, 72 are in the closed position to maintain the panel 14 in position. Additionally, if the optional hardware 78 is used, the hardware provides additional support to the panel 14 and prevents the first and second vertical sidewall sections 70, 72 from moving back toward the open position. This provides additional safety in areas which have increased seismic activity.

Depending upon the configuration and size of the panels 14, each mounting clip 10 is long enough to provide sufficient teeth 74 to support the weight of the panel 10 in the vertical position or a combination mounting clips 10 are sufficient to support the weight of the panel 10 in the vertical position.

In the exemplary embodiments, if the screw is loosened, the mounting clips 10 may slide freely along the support member 16. This allows the mounting clips, and ultimately the panels 14, to be positioned and repositioned in the appropriate location to achieve the desired acoustic properties or the desired aesthetics.

While the exemplary embodiment described that the mounting clips 10 are mounted on the support member 16 first and the panels 14 are then mounted to the mounting clips 10, this is just one exemplary method of assembly. As one exemplary alternative, the panels 14 may be mounted to the mounting clips 10 prior to the mounting clips being mounted to the support member 16.

Another alternate exemplary embodiment, not shown, has first and second vertical sidewall sections with no teeth. The mounting hardware extends through the openings provides the support for the panel. In this embodiment the first and second vertical sidewall sections are fixed and do not move between and open and a closed position.

Figure 18:
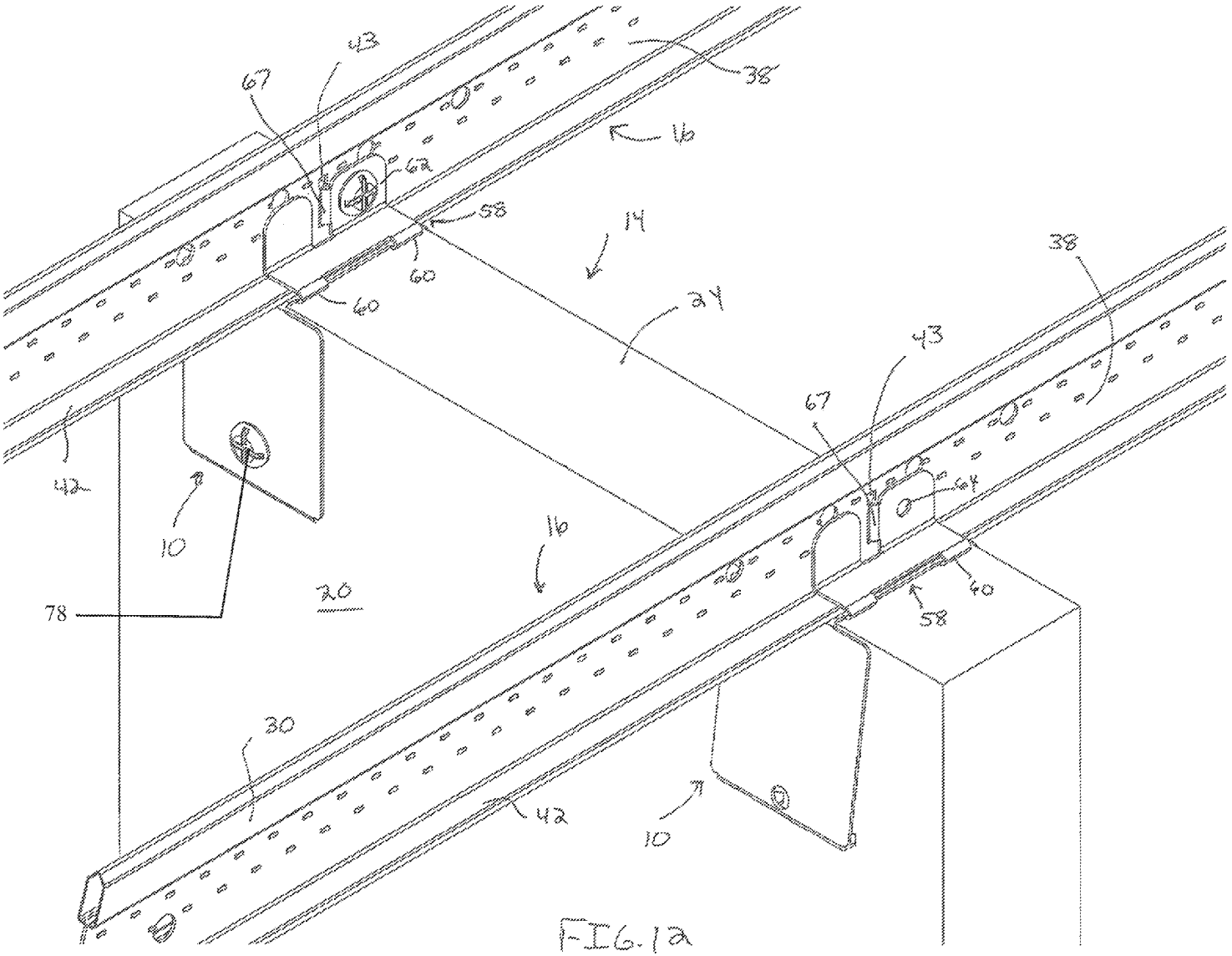
FIG. 18 is a perspective view of numerous panels mounted on the support member.
Figure 17:
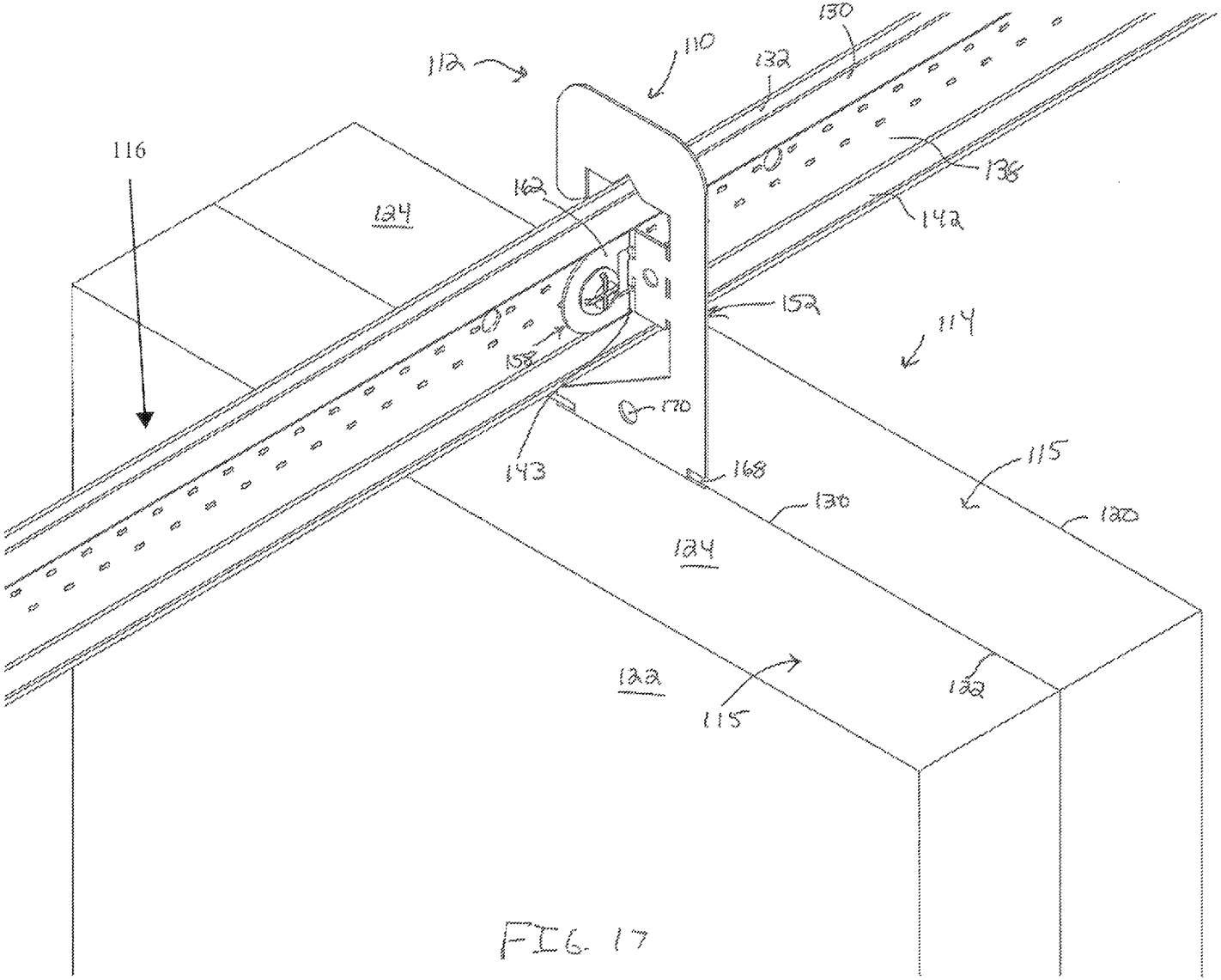
FIG. 17 is a perspective view of a panel mounted on the support member using the mounting hardware of FIG. 13.
Figure 18:
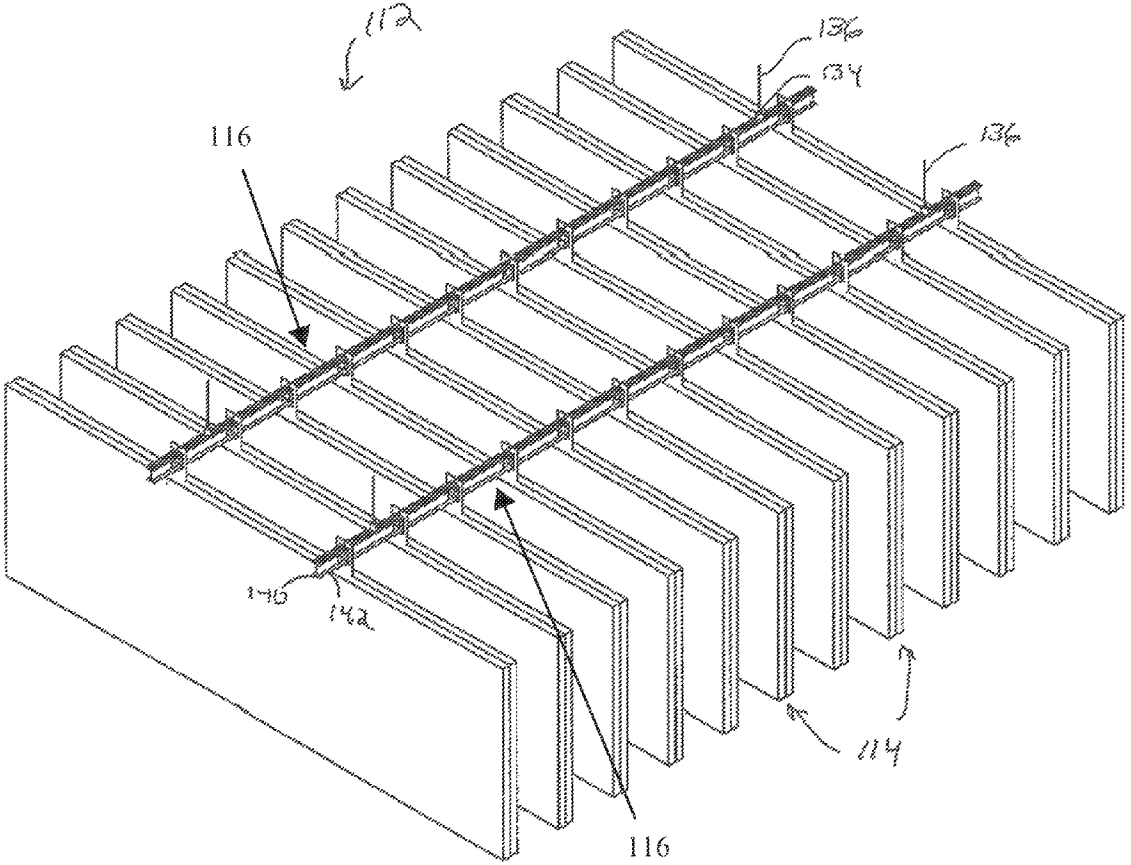

Another alternate exemplary embodiment is illustrated in FIGS. 13 through 18. The mounting system 112 provides a platform for mounting at least one overhead, vertical panel 114 that is supported on the support member 116, as will be discussed in further detail below. The overhead panel 114 drops down in a generally vertical orientation from the plane of the ceiling and can be combined with additional panels 114 (as shown in FIG. 17) or used individually. FIG. 18 illustrates a perspective view of the overhead mounting system 112 in accordance with this exemplary embodiment. The mounting system 112 includes one or more support members 116, the mounting hardware 110, and one or more panels 114.

The panels 114 are made by joining two panels 115. The panels 115 any known panels which perform the desired function. In general, each panel 115 is made from lightweight material having a first surface 120 and an oppositely facing second surface 122. A mounting surface or edge 124 extends between the first surface 120 and the second surface 122. In the exemplary embodiment shown, the panels 114 are rectangular, however, the panel can take any suitable shape, length, or width. While other embodiments may be used, in one example the panel 114 contains a cellular core having first and second side walls that are covered by a veneer or laminated outer skin. The veneer or outer skin may be any color according to the aesthetic desired. The cellular core may be made of a foam material, such as, but not limited to polystyrene that allows the vertical panel to be lightweight, for example, around 1-2 pounds per linear foot of elongate length. The outer skin may be formed of a suitable lightweight material, such as, but not limited to, material having the acoustic properties required, high impact polystyrene or expanded PVC. The type of material will depend upon the application for which the panel is to be used.

In the exemplary embodiment shown, the support members 116 have a modified I-shaped cross-section, which is most clearly shown in FIGS. 17 and 18. The support member 116 has a top mounting section 130 having a slot 132 for receiving and end 134 of a mounting wire 136 which is mounted to the ceiling or the like. However, other configurations of the top mounting section 130 and other methods of mounting the support member 116 to the ceiling can be used without departing from the scope of the invention. A vertical flange 138 extends between the mounting section 130 and horizontal cross members or flanges 140, 142. Locating slots 143 may also be provided periodically along the vertical flange 138.

According to the exemplary embodiment, the mounting hardware or mounting clip 110 includes a generally vertical plate section or panel mounting section 150 with a support member receiving portion or hook arm 152 which extends thereof. Extending from a portion of the hook arm 152 is a movable mounting section 158. The movable mounting section 158 has connection legs 160 which extend between the hook arm 152 and the mounting section 158, the legs 160 being configured to allow the mounting section 158 to rotate about the hook arm 152. The mounting section 158 has a mounting flange 162 with at least one screw receiving opening 164 which extends therethrough. More than one screw receiving opening 164 may be provided to allow the mounting section 158 to be bent to accommodate different support members 116 and still be secured thereto. A locating tab 167 may also be provided on the mounting section 158.

The configuration of the hook arm 152 is designed to allow the hook arm 152 to be inserted on standard grid, U-profiles, I-beam carrying members, peaked roof bulb design and other such configurations.

The plate section 150 has openings 166 which extend therethrough. The openings 166 allow adhesive to flow therethrough, as will be more fully described. Alignment notches 168 and a mounting opening 170 are also provided on the plate section 150. Projections or teeth 174 (as best shown in FIGS. 13 through 15), extend from both sides of the plate section 150. In the exemplary embodiment shown, the teeth 174 are formed along the edge of the plate section 150 which is furthest from the hook arm 152. The teeth 174 are in general vertical alignment with each other. However, other configurations of the teeth 174 are possible without departing from the scope of the invention.

In this embodiment, the mounting clips 110 are embedded in the panels 115 as the panels 115 are formed. Panels 114 have adhesive applied to facing surfaces. The panels 114 are moved together. As this occurs, the mounting clips 110 are positioned between the panels 114 such that the movement of the panels 114 together causes the mounting clips 110 to be captured between the panels 114. As this occurs, the teeth 174 engage and pierce the panels 114. Continued movement of the panels 114 toward each other causes the plate section 150 to be trapped between the panels 114. In this position, the adhesive applied to the panels 114 flows through the openings 166 to provide a strong bond between the panels 114 and the plate section 150. The alignment notches 168 are positioned proximate the top of the panels 114 to provide visual alignment as the panels and mounting clips 110 are joined together.

The mounting hardware or mounting clips 110 cooperate with the support members 116 to mount the panels 114 to the support members 16 and indirectly to the ceiling. As shown in FIG. 16, the hook arm 152 of each respective mounting clip 10 is configured to wrap around a respective the support member 116. Once the hook arm 152 is positioned on the support member 116, the movable mounting section 158 is rotated or pivoted about the connection legs 160, thereby allowing the mounting flange 162 to be moved proximate a vertical flange 138 of the support member 116. As this occurs, the locating tab 167 may be inserted into a respective locating slot 137 to help properly position the mounting clip 110 relative to the support member 116. With the mounting flange 162 positioned proximate the vertical flange 138, a screw may be inserted into either the appropriate screw receiving opening 164, thereby causing the mounting clips 110 to be securely fastened and positioned relative to the support members 116.

If the screw is loosened, the mounting clips 110 may slide freely along the support member 116. This allows the mounting clips, and ultimately the panels 114, to be positioned and repositioned in the appropriate location to achieve the desired acoustic properties or the desired aesthetics.

As will be appreciated from all of the embodiments, different number of panels can be mounted in differing configurations to accommodate the acoustic and/or aesthetic characteristics desired.

The mounting clips and mounting system allows for the panels to be removed and repaired/replaced if there is damage. There is no need to remove the mounting hardware or the mounting system in order to accomplish the repair/replacement.

The mounting clips and mounting system also allow for the repositioning of the panels. This allows for the panels to be repositioned as the needs or space changes.

The mounting clips and mounting system are also versatile. A wide range of materials and sizes of panels can be installed with the same hardware and same system, thereby reducing the need to change hardware.

The exemplary clips can be used to hang panels from standard grid, U-profiles, I-beam carrying members, peaked roof bulb design and other such configurations.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for mounting a vertical panel from a ceiling, the system comprising:

a support member suspended from the ceiling;

a mounting clip for mounting the vertical panel to the support member, the mounting clip comprising:

a horizontal plate having a top surface, a bottom surface, a first end, and a second end opposite the first end;

a movable mounting section rotatably coupled to the second end of the horizontal plate so as to be rotatable about a first rotational axis, the movable mounting section comprising a horizontal portion and a mounting flange extending downwardly from the horizontal portion; and wherein the movable mounting section is rotatable between: (1) a first position in which a top surface of the horizontal portion of the movable mounting section is in plane with the top surface of the horizontal plate; and (2) a second position in which the top surface of the horizontal portion of the movable mounting section is adjacent to the top surface of the horizontal plate so that a first slot is formed between the top surface of the horizontal portion of the movable mounting section and the top surface of the horizontal plate;

wherein in each of the first and second positions the mounting flange of the movable mounting section is oriented perpendicular to the horizontal plate; and wherein in the first position the mounting flange of the movable mounting section extends below the bottom surface of the horizontal plate and in the second position the mounting flange of the movable mounting section extends above the top surface of the horizontal plate.

2. The mounting system of claim 1 wherein the movable mounting section rotates approximately 180° about the first rotational axis when transitioning from the first position to the second position.

3. The mounting system of claim 1 further comprising a first leg extending between the horizontal plate and the movable mounting section and a second leg extending between the horizontal plate and the movable mounting section, the first and second legs spaced apart from one another along the second end of the horizontal plate by a gap.

4. The mounting system of claim 1 wherein the mounting flange of the movable mounting section comprises a first flange and a second flange that are spaced apart from one another along an end of the horizontal portion of the movable mounting section.

5. A system for mounting a vertical panel from a ceiling, the system comprising:

a support member suspended from the ceiling;

a mounting clip for mounting the vertical panel to the support member, the mounting clip comprising:

a horizontal plate having a top surface, a bottom surface, a first end, and a second end opposite the first end;

a hook arm extending upwardly from the first end of the horizontal plate;

a movable mounting section rotatably coupled to the second end of the horizontal plate so as to be rotatable about a first rotational axis, the movable mounting section comprising a horizontal portion and a mounting flange extending downwardly from the horizontal portion;

wherein the movable mounting section is rotatable between: (1) a first position in which a top surface of the horizontal portion of the movable mounting section is in plane with the top surface of the horizontal plate; and (2) a second position in which the top surface of the horizontal portion of the movable mounting section is adjacent to the top surface of the horizontal plate so that a first slot is formed between the top surface of the horizontal portion of the movable mounting section and the top surface of the horizontal plate; and wherein a second slot is formed between the hook arm and the top surface of the horizontal plate.

6. The mounting system of claim 5 wherein the support member comprises a vertical flange, a first horizontal flange and a second horizontal flange, and wherein when the movable mounting section is in the second position and the mounting clip is mounted to the support member, the first horizontal flange of the support member is positioned within the first slot and the second horizontal flange of the support member is positioned within the second slot.

7. The mounting system of claim 6 wherein when the movable mounting section is in the second position and the mounting clip is mounted to the support member, a first major surface of the mounting flange of the movable mounting section is in contact with the vertical flange of the support member and the horizontal portion of the movable mounting section rests atop the first horizontal flange of the support member.

8. The mounting system of claim 7 further comprising a locating tab extending from the mounting flange of the movable mounting section, wherein when the first major surface of the mounting flange of the movable mounting section is in contact with the vertical flange of the support member, the locating tab is positioned within a locating slot on the vertical flange of the support member.

9. A system for mounting a vertical panel from a ceiling, the system comprising:

a support member suspended from the ceiling;

a mounting clip for mounting the vertical panel to the support member, the mounting clip comprising:

a horizontal plate having a top surface, a bottom surface, a first end, a second end opposite the first end, a first edge, and a second edge opposite the first edge, each of the first and second edges extending between the first and second ends;

a movable mounting section rotatably coupled to the second end of the horizontal plate so as to be rotatable about a first rotational axis, the movable mounting section comprising a horizontal portion and a mounting flange extending downwardly from the horizontal portion;

a first vertical sidewall extending downwardly from the first edge of the horizontal plate, the first vertical sidewall rotatably coupled to the first edge of the horizontal plate so as to be rotatable about a second rotational axis; and a second vertical sidewall extending downwardly from the second edge of the horizontal plate, the second vertical sidewall rotatably coupled to the second edge of the horizontal plate so as to be rotatable about a third rotational axis; and wherein the movable mounting section is rotatable between: (1) a first position in which a top surface of the horizontal portion of the movable mounting section is in plane with the top surface of the horizontal plate; and (2) a second position in which the top surface of the horizontal portion of the movable mounting section is adjacent to the top surface of the horizontal plate so that a first slot is formed between the top surface of the horizontal portion of the movable mounting section and the top surface of the horizontal plate.

10. The mounting system of claim 9 wherein the first rotational axis is substantially transverse to each of the second and third rotational axes.

11. The mounting system of claim 9 wherein an inner surface of the first vertical sidewall is spaced apart from an inner surface of the second vertical sidewall by a distance thereby forming a panel mounting cavity, and wherein a plurality of teeth extend from each of the first and second vertical sidewalls into the panel mounting cavity.

12. The mounting system of claim 11 wherein the first and second vertical sidewalls are collectively rotatable between: (1) an open position in which the distance between the inner surfaces of the first and second vertical sidewalls is configured to be greater than a width of the vertical panel; and (2) a closed position in which the plurality of teeth of the first vertical sidewall are configured to pierce a first major surface of the vertical panel and the plurality of teeth of the second vertical sidewall are configured to pierce a second major surface of the vertical panel.

13. The mounting system of claim 12 wherein in the closed position the plurality of teeth of the first and second vertical sidewalls are configured to protrude into the vertical panel and the plurality of teeth of the first vertical sidewall remain spaced apart from the plurality of teeth of the second vertical sidewall.

14. The mounting system of claim 9 further comprising the first and second vertical sidewalls configured to support the vertical panel so that a panel axis extending along a top edge of the vertical panel is substantially transverse to a longitudinal axis of the support member.

15. A system for mounting a vertical panel from a ceiling, the system comprising:

a support member suspended from the ceiling;

a mounting clip for mounting the vertical panel to the support member, the mounting clip comprising:

a horizontal plate having a top surface, a bottom surface, a plate axis extending between a first edge and a second edge, and a first end and a second end extending between the first and second edges;

a movable mounting section rotatably coupled to the second end of the horizontal plate so as to be rotatable about a first rotational axis, the first rotational axis being substantially parallel to the plate axis;

a first vertical sidewall extending downwardly from and rotatably coupled to the first edge of the horizontal plate so as to be rotatable about a second rotational axis, the second rotational axis being substantially transverse to the plate axis; and a second vertical sidewall extending downwardly from and rotatably coupled to the second edge of the horizontal plate so as to be rotatable about a third rotational axis, the third rotational axis being substantially transverse to the plate axis; and wherein the movable mounting section comprises a horizontal portion coupled to the second end of the horizontal plate and a mounting flange extending downwardly from the horizontal portion, and wherein the movable mounting section is rotatable between: (1) a first position in which a top surface of the horizontal portion of the movable mounting section is in plane with the top surface of the horizontal plate; and (2) a second position in which a slot is formed between the top surface of the horizontal portion of the movable mounting section and the top surface of the horizontal plate.

16. The mounting system of claim 15, further comprising:

the support member having a vertical flange and a horizontal flange; and wherein when the mounting clip is coupled to the support member, the mounting flange is in contact with the vertical flange of the support member and the horizontal flange of the support member is positioned within the slot so that a top surface of the horizontal flange is adjacent to the movable mounting flange and a bottom surface of the horizontal flange is adjacent to the top surface of the horizontal plate.

* * * * *